US005335509A

United States Patent [19]

Namisniak et al.

[11] Patent Number: 5,335,509

[45] Date of Patent: Aug. 9, 1994

[54] FOOD INVENTORY SYSTEM

[76] Inventors: Dianna Namisniak; Lee Namisniak, both of 22592 Le Dana, Mission Viejo, Calif. 92691

[21] Appl. No.: 98,521

[22] Filed: Jul. 28, 1993

[51] Int. Cl.[5] ..... G09F 9/00

[52] U.S. Cl. ..... 62/125; 116/308; 340/585; 368/108; 206/459.1

[58] Field of Search ..... 62/125, 126, 127, 129, 62/157, 158; 116/307, 308, 205; 283/55; 206/459.1, 459.5; 340/585, 588; 368/10, 89, 107, 108, 109

[56] References Cited

U.S. PATENT DOCUMENTS

| | | | |
|---|---|---|---|
| 2,216,127 | 10/1940 | McNaught | 62/125 X |
| 3,818,858 | 6/1974 | Kramer et al. | 116/308 |
| 3,837,104 | 9/1974 | Brotschi | 283/55 X |
| 4,292,916 | 10/1981 | Bradley et al. | 116/308 X |
| 4,619,221 | 10/1986 | Linstromberg | 116/307 |
| 4,893,477 | 1/1990 | Vazquez | 62/125 |
| 5,129,536 | 7/1993 | Robinson | 220/211 |

*Primary Examiner*—Harry B. Tanner

*Attorney, Agent, or Firm*—Price, Gess & Ubell

[57] ABSTRACT

A method and device for ensuring the consumption of perishable food items before the safe storage lifetime of the items has elapsed. A base unit which is mounted near or removably attached to a food storage location such as a refrigerator and allows identification and timing of the stored food items. When an item is placed into the storage location, its name and storage lifetime are recorded on the base unit. This recording may be accomplished manually by writing directly onto the base unit or by use of handwritten or preprinted labels, or recording may be accomplished electronically through a microprocessor-controlled base unit. For ease of later location the item may be optionally stored inside of food storage containers that are color coded to the base unit. The base unit also provides an electronic timing display for each stored item. This display can be activated when an item is stored so that the length of time an item has been stored can be readily determined and compared with the safe storage lifetime that is also provided for each food item.

23 Claims, 3 Drawing Sheets

FOOD INVENTORY SYSTEM

BACKGROUND OF THE INVENTION

1. Field of the Invention

This invention relates to methods and devices to ensure the safe storage of food and, specifically, to a method and device to display the identity and storage time of food items in a refrigerator.

2. Description of Related Art

Most people have discovered mold growing on food in a refrigerator. The common response is a slight shudder of revulsion followed by quick disposal of the offending item. Sometimes one does not discover the problem until the food is being prepared for consumption or is actually about to be eaten. If the spoilage is not readily visible, the tainted item may actually be eaten, with mild to severe medical consequences. Although the problem is most apparent with readily perishable food in a refrigerator, food in a freezer, and even dried or canned food in a cupboard also deteriorate, albeit at a slower pace. The prior art solution to this pervasive problem has ranged from periodic disposal of all stored items to various lists attached to the front of the refrigerator or cupboard and manually maintained.

The problem with manual lists is that it is difficult to unambiguously identify the stored items. If one stored a piece of cheese in a refrigerator and wrote "cheese" on a list on the refrigerator door, confusion would result if there were more than one piece of cheese in the refrigerator. An attempt could be made to track the age of the particular item by also writing the date of storage on the list. Unfortunately, it is very difficult to look at such a list and immediately spot the item which is approaching the end of its useful life. When faced with a list of dates, the human mind does a poor job of instantly computing the current age of the item based on its date of storage. Also, most people do not have a clear idea of how long a given leftover should be stored. Furthermore, even if a leftover on the list is identified as approaching the end of its useful life, it is often difficult to easily locate the leftover in the refrigerator. Many perishable items cleverly hide on upper shelves or behind other items.

It is an object of the present invention to solve these common problems of food storage management;

It is another object to provide a method and device to furnish a ready display of the names of the stored food items, an indication of how long such an item should be stored, and a display of how long each item has actually been stored; and It is a further object of the present invention to provide a quick and simple way to locate a food item stored inside a crowded refrigerator.

SUMMARY OF THE INVENTION

The invention is comprised of a base unit that is designed to maintain both a list of the stored food items, including the recommended maximum storage period for each item, and a display of how long each item has been in storage. Additionally, the invention may comprise an assortment of food storage containers made of plastic or some other suitable material. The storage containers are keyed to the list on the base unit. The base unit is a substantially flat device. It is more or less rectangular in shape and would normally be about the size of a standard sheet of paper. It is designed to be removably attached to or placed near the food storage location. The base unit performs three main tasks: a cataloging task, an associating task, and a timing task.

The cataloging task can be thought of as a flexible form of list-keeping. The base unit has a number of item slots, each of which serves as a position for the entry of a potential item on a list. For example, a typical base unit might have 14 item slots. This means that the unit could simultaneously track 14 food items: the item list could be up to 14 items in length. The important thing is that the base unit allows the item slots to be reversibly filled so that a list of stored items can be flexibly maintained. In the very simplest embodiment an item slot would be a rectangular region on the smooth surface of the base unit. To add a newly-stored item of food to the list one would simply write the name of the item onto the slot with a dry-erasable felt marker pen. To delete an item (when the leftover has been removed from storage), the slot would simply be wiped with a paper towel or cloth to erase the name.

A slightly more advanced version of the invention provides preprinted food names which are printed on or laminated onto thin magnetic tabs. The base unit surface is constructed of a magnetic material, and the preprinted names can be removably attached to fill a slot. The unused names can be stored in alphabetical order on the face of the refrigerator with other refrigerator magnets. Custom items for which no preprinted tabs existed can be created by either writing directly on the base unit with an erasable pen, as already explained, or by writing on a blank magnetic tab. After the item is consumed, the tab can be erased so that another item name can be written onto it. Alternately, the tab can be detached from the item slot and placed with the preprinted tabs so that the handwritten entry can be used again in the future.

In the most advanced version of the invention, a microprocessor provides the names of the stored items and controls their display. A portion of the face of the base unit, including the item slots, is a display screen such as a liquid crystal display (LCD). An input device such as a keyboard is also provided. By manipulating the input device, the name of the item of food to be stored is displayed in one of the empty item slots on the face of the base unit.

It will be appreciated that the cataloging task explained thus far is much more flexible than list-keeping methods that are known in the prior art. Moreover, the cataloging task also encompasses a lifetime function. The lifetime function comprises a method of providing storage lifetimes for the perishable items to be stored. In the simplest embodiment it would be a printed list of the lifetimes. For example, green beans might have a storage life of five days. If the cataloging task were implemented by writing with an erasable pen on the front surface of the base unit, this lifetime "5" would be entered beside the name on the blank item slot. In the case of preprinted magnetic tabs, the recommended lifetime would come preprinted next to the name of the food item. Finally, the microprocessor implementation would automatically provide the lifetime along with the item name, and display both on an item slot.

If the user disagrees with a provided lifetime, the user could alter it by using the erasable pen with the magnetic tab version or by a simple key stroke with the microprocessor version. Finally, many products such as yogurt or milk come from the store already marked with a preprinted expiration date. In that case, the user would write the date, in a numerical month/date format (i.e. 7/29 for Jul. 29), on the base unit item slot (on a tab or directly on the surface, depending on the version of the invention) or enter it with the microprocessor input device.

The second task is the association task. As explained above, a problem with keeping lists of stored items has been the difficulty of readily finding the item if it is in a closed container and of differentiating items if more than one example of a given item-type is stored at the same time. The association task is an integral part of the present invention that solves this nagging problem. As already explained, the face of the base unit contains a column of item slots which are used to create a list of the stored items and display their storage lifetimes. Next to each item slot is an identifier swatch. The identifier swatch is preferably a small patch of color or pattern. Ideally there would be between four and six different colors or patterns. Red, green, blue, and yellow would be a preferred choice of four colors.

The invention also comprises a series of food storage containers in a number of different sizes. These are ordinary, reusable containers of plastic or other suitable materials for storage purposes. However, each container prominently displays an identifier that matches one of the identifier swatches on the base unit. For example, the lids of the containers might match the color or pattern of a given identifier swatch. Reusable bands or disposable tapes that match identifier swatches can also be provided to mark prepackaged perishables such as yogurt or milk.

One begins the association task by choosing a storage container sized to fit the food item or an appropriate marking band and puts the item in the container or marks it with the band before putting the item into the refrigerator. Next, one chooses an empty item slot on the base unit whose identifier swatch matches that on the already chosen container or marking band. As already explained, each item slot is associated with an identifier. The user enters the name and lifetime into the slot. Now the entry on the list is associated with an item in the refrigerator or other storage location. Because the identifiers are of a bright color or pattern, one can easily locate the item within the refrigerator. As each stored item is consumed, its item slot is reclaimed by either erasing the handwritten label, removing the preprinted magnetic tab, or by operating the microprocessor input device to clear the entry.

There is a tension between the number of different identifiers and the ease of locating an item. If there are a large number of different identifiers, it will be easy to locate a stored item, since there will only be one container in the refrigerator with that identifier. If there is a relatively small number of different identifiers, there is a good chance that there will be more than one container with a given identifier in the refrigerator at one time. However, a large number of different identifiers would require a prohibitively large number of food storage containers if there is to be a variety of sizes for each identifier. A choice of between four and six different identifiers results in a good balance between ease of locating an item and an excessive number of food containers.

The way that the cataloging task creates a list of stored items along with their storage lifetime and how the association task links the list entry with a particular stored item has now been explained. The timing task completes the present invention. The timing task displays the time that has elapsed since the item was placed into storage. When the elapsed time exceeds the lifetime shown on the item slot, the item is no longer fit to eat.

The timing task is executed by a series of electronic timing circuits, preferably with an electronic display for each item slot. Associated with each display is one or more buttons or switches that activate, inactivate, or otherwise control that particular display. Preferably, the buttons or switches are immediately adjacent to each display, but for economy they might be grouped on a keypad at a single location on the base unit, and a single button might be used to control multiple slots (i.e., a given item slot could be selected by punching in its number, and its display then activated by pushing a single activation button). In the microprocessor version of the invention, the timing display is actually part of the same screen that displays the item slots with their names.

After the cataloging task and the association task have been completed (i.e., the item slot is filled in and the item is stored in an identifying container), the timing task is performed: the timing display associated with the item slot is activated. This is accomplished by pressing the appropriate button. When the item is removed from storage and the item slot is cleared, the timing function is deactivated either by pressing the button a second time or, depending on the exact embodiment of the invention, pressing a special "stop" button. With the microprocessor version of the invention, the timing function is automatically activated by the process of invoking the cataloging task to put a name into an item slot. When the item is removed from storage, the slot is selected and a button is pressed to delete both the item name and the timing display.

The display shows elapsed time in appropriate timing intervals that match the lifetimes entered in the item slot. When the invention is used to track leftovers in a refrigerator, these increments are days. For the tracking of frozen or dried food, the increments are weeks or months. A particular base unit might display only one of the possible timing increments. Alternatively, a switch or switches could be provided that would alter the timing increments of individual or of all the displays on a base unit. The microprocessor version is most flexible and can automatically select and display the appropriate timing interval by selecting an appropriate storage location button.

Items such as milk or yogurt that have a month/day expiration date are treated slightly differently. In that case, one of the control buttons causes the timing display to show the month/day rather than just elapsed time. For example, in the elapsed time mode (day increments), the timing display will show "0" when it is first activated. Preferably, this display would be next to the lifetime on the item slot. Thus, if the item were salad with a three-day lifetime, the item slot and timing display would look like this: "SALAD 3 0." Each day the timing display is automatically incremented by one day. After 24 hours, the slot and display will read: "SALAD 3 1." After three days, the display will match the lifetime number, indicating that the salad is at the end of its useful lifetime. The goal is to consume the salad before the timing display exceeds the lifetime. In the case of yogurt the timing display is placed in the month/day mode. In that mode the display shows the month/day either by flashing the digits alternately, or by showing them simultaneously, depending on the version of the invention. Thus, upon activation, the item slot and display would read: "YOGURT 7/15 7/12." The next day the line would read: "YOGURT 7/15 7/13." When the display exceeds the lifetime, the product is no longer useable. The microprocessor version handles the process the most elegantly: the unit can display the lifetimes as explained above, or it can display in a countdown mode which shows how many useful days of life are left. Furthermore, the microprocessor has an alert mode that flashes the item slot entry on and off as that item approaches or exceeds its useful lifetime.

The present invention helps to minimize loss of leftover, perishable, or dated foods through spoilage, thereby saving money. It also speeds meal planing and preparation by eliminating the need to open multiple containers to determine refrigerator inventory. Furthermore, the inventory maintained through the cataloging task is a ready source of data for manual or automated production of shopping lists.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Figure 1:
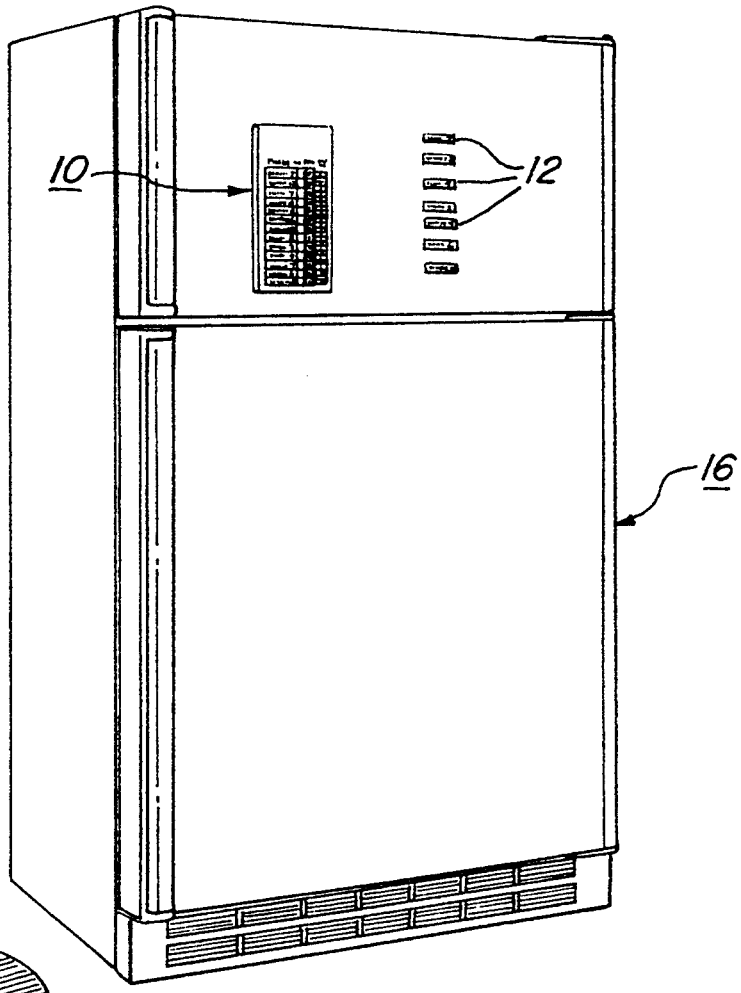
FIG. 1 is a perspective view of the magnetic tab version of the invention shown on a refrigerator.
Figure 5:
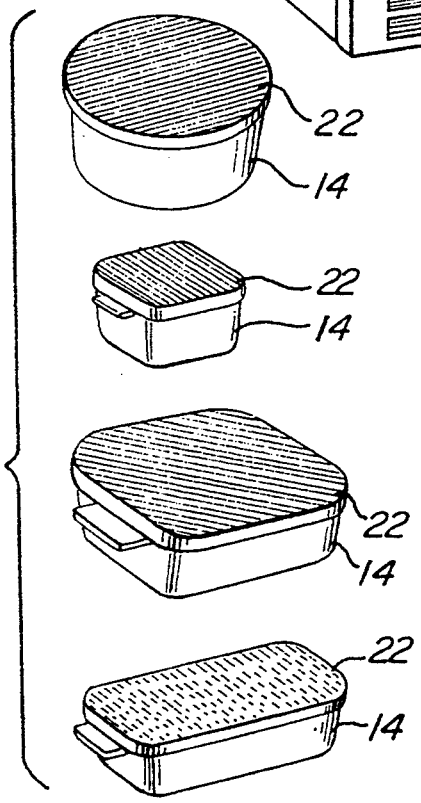
FIG. 5 shows a number of the identifier marked food storage containers.
Figure 3:
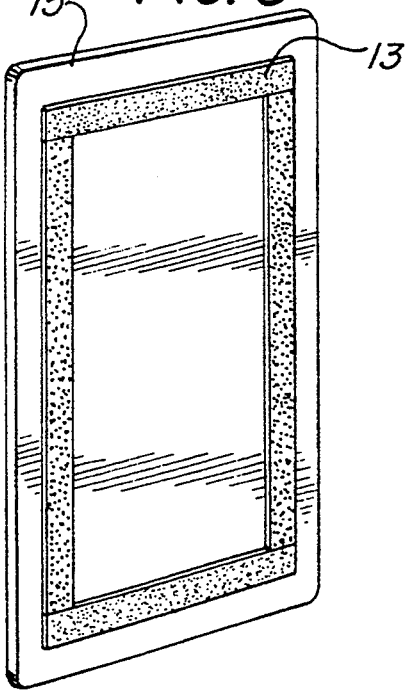
FIG. 3 is a diagram of the back surface of the magnetic tab embodiment of the present invention.
Figure 4:
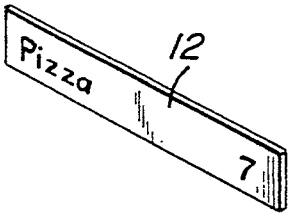
FIG. 4 is a representation of a single preprinted magnetic tab.

FIG. 1 shows the present invention in use. A base unit 10 is detachably mounted to the face of a refrigerator 16 by magnetic strips 13 located on the back surface 15 of the unit (see FIG. 3). Also shown on the front of the refrigerator are a number of magnetic tabs 12, one of which can be seen in FIG. 4, which are used in the cataloging task which is explained below. FIG. 5 shows several food container 14 marked with identifiers 22 and suitable for use in the present invention.

Figure 2:
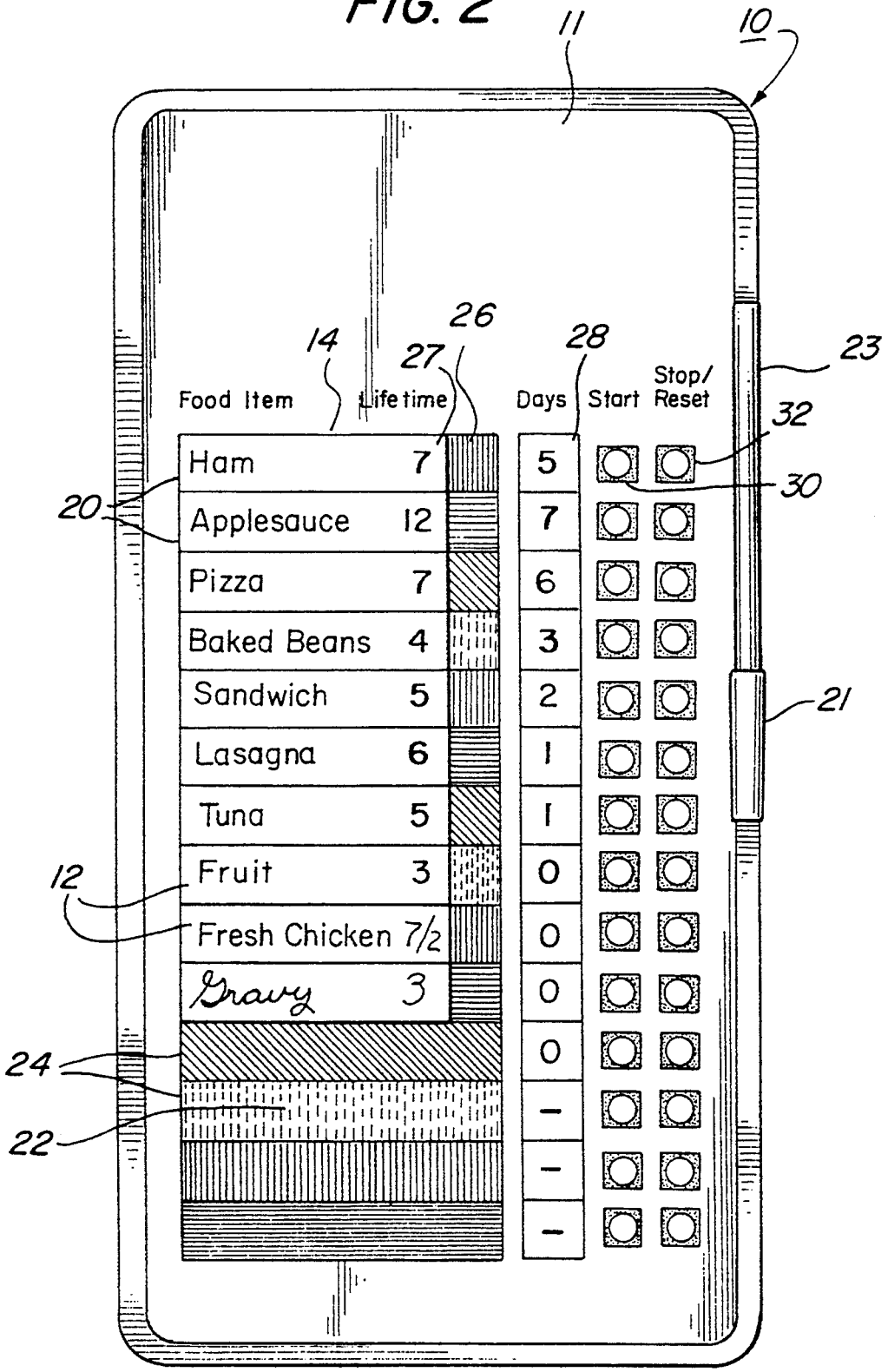
FIG. 2 is a diagram of the front surface of the base unit of the magnetic tab embodiment of the present invention.

FIG. 2 shows a view of the front surface 11 of the base unit 10 in the magnetic tab embodiment of the present invention, also shown in FIG. 1. The workings of the invention can be explained by reference to FIG. 2. There is a holder 21 for a dry-erasable pen 23. There is a vertical column 14 of empty item slots 24. The surface of the item slot 24 is of painted or enameled steel or other magnetic material marked with an identifier 22. A preprinted magnetic tab 12 (see FIG. 4) can be removably attached to create a filled item slot 20.

The identifier 22 is preferably a color or a pattern and can be seen most readily in an empty item slot 24. A portion of the identifier 22 is also visible in the filled item slot 20 as an identifier swatch 26 because the tab 12 is not as long as the slot 24. As explained above, the optimal number of identifiers is between four and six. This will provide relative ease in locating a stored food item and still not require an excessive number of food storage containers. Ideally, there will be a choice of several different container sizes marked with each identifier.

Next to the identifier swatch 26 at the end of the item slot 20 is a timing display 28. The timing displays 28 form a vertical column 27, one for each filled item slot 20 and each empty item slot 24. Next to each timing display 28 is a start button 30 and a stop button 32. Like the timing displays 28, the buttons 30, 32 are arranged in vertical columns, with one start button 30 and one stop button 32 for each timing display 28. The timing displays 28 are attached to electronic circuits (not shown) within the base unit 10, and the buttons adjacent to each timing display control that particular display. Pressing the start button 30 activates the adjacent display 28, causing it to display "0." Twenty-four hours later the display will increment to show "1." Pressing the start button 30 a second time invokes the expiration date mode. This is used for products like milk that have a month/day expiration date. When the expiration mode is activated, the display will show the month and day by alternately flashing the appropriate numbers. For example, if the current date were July 15, the display would flash "7," followed by "/" and then by "15"; then the display would blank for a moment and then repeat the sequence. Pressing the start button 30 a third time would invoke the countdown mode. This is indicated by the display showing a flashing "1" rather than the date. In this mode the display decrements one day each 24 hours, rather than incrementing one day. Finally, pressing the stop button 32 stops the clock and causes the display to show "-- ". The clock can be restarred by pressing the start button. Pressing the stop button 32 a second time resets the clock and deactivates the display, causing it to be entirely blank.

The details of the base unit 10 now having been explained, one can readily understand the functioning of the entire method. For example, suppose that one had a portion of baked beans that one wished to inventory and place into the refrigerator. One would first select an appropriately-sized food container 14 for the item to be stored, place the item into the container, and place the container into the refrigerator. One would then look at the base unit 10 to discover if there were an empty item slot 24 whose identifier swatch 26 matched the identifier 22 of the selected storage container 14. Assuming that there were an empty slot 24, one would then inspect the preprinted magnetic tabs 12 which are stored in alphabetical order on the front surface of the refrigerator 16 and select the tab 12 for baked beans. Alternately, if there were no preprinted tab 12 for baked beans, one would take the pen 23 and write "Baked Beans" on a blank magnetic tab 12 (or directly on the surface of the empty item slot 24). One would then place the magnetic tab 12 for "Baked Beans" onto the empty item slot 24, where it would adhere magnetically. The tab 12 is shorter than the empty item slot 24 so that a portion of the item slot identifier 22 shows as the identifier swatch 26 to the right of the magnetic tab 12. If, for some reason, one had decided not to use one of the identifier-coded food containers 14, this would be indicated by placing the magnetic tab 12 so that the identifier swatch 26 appears to the left of the tab 12.

At the right-hand end of the magnetic tab 12 is printed the item lifetime (e.g. "4" for Baked Beans);

farther to the right is the timing display 28 for that filled item slot 20. One activates the display 28 by pressing the start button 30. The display 28 will increment each day. When the display 28 number exceeds the lifetime number, the baked beans are no longer safe to eat. If one selects the countdown mode, one would then press the start button 30 repeatedly until the display 28 shows the item lifetime ("4" in this case). The display 28 will decrement each day and flash to indicate the countdown mode is in operation. When a negative number is displayed, the baked beans are no longer fit to eat. The advantage of the countdown mode is that it is easy to see at a glance how many days of life are left for an item. If the expiration mode is selected, the item is safe to consume until the date flashed on the display 28 exceeds the expiration date written on the tab 12.

Figure 6:
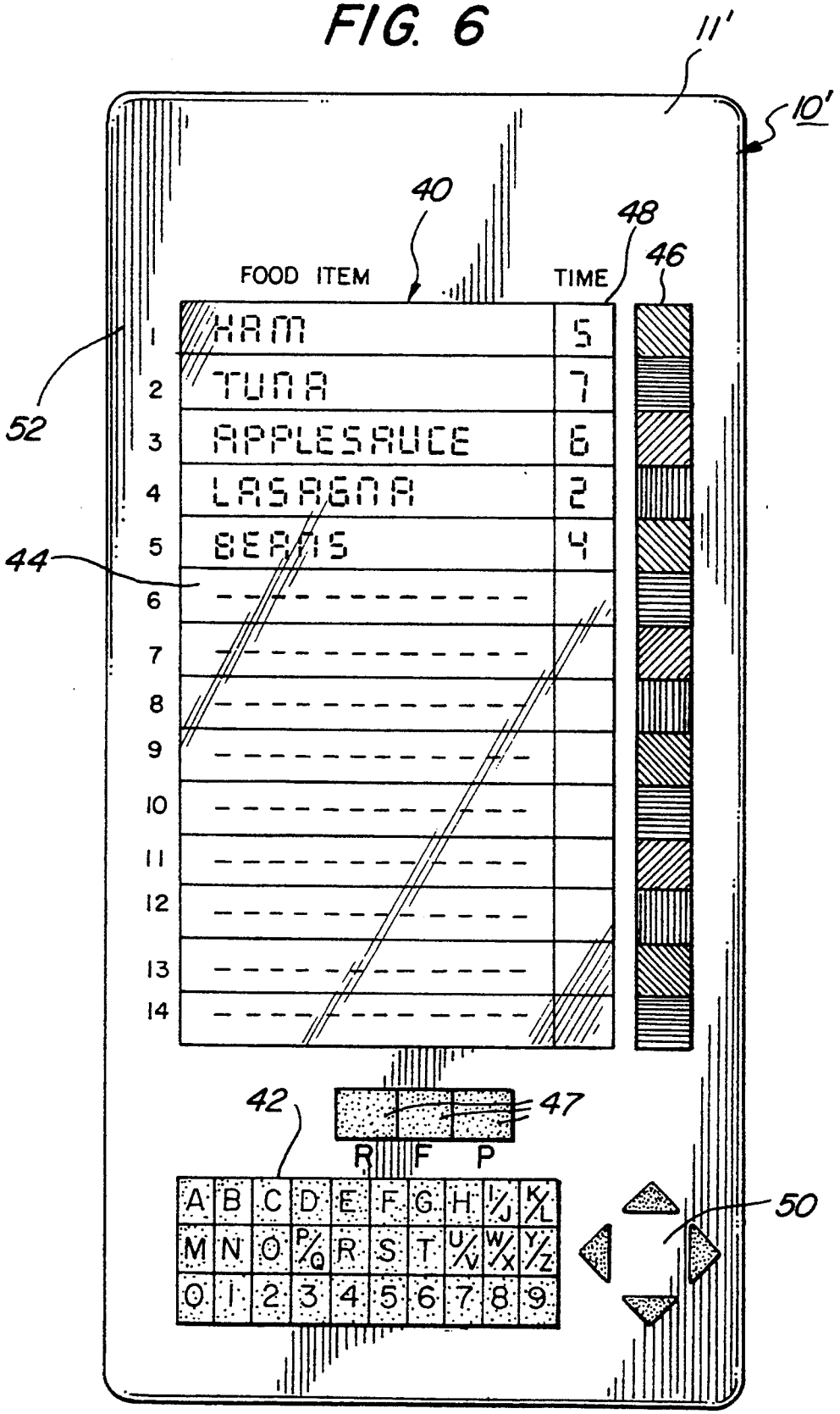
FIG. 6 is a diagram of the front surface of the base unit of the microprocessor embodiment of the present invention.

FIG. 6 shows the microprocessor version of the current invention. Much of the front surface area 11' of the base unit 10' is covered by an LCD screen 40. In this embodiment of the invention the screen displays fourteen lines allowing fourteen item slots 44. Each item slot 44 is numbered at its left-hand end (the top slot is number 1, while the bottom slot is number 14). The right-hand end of the screen is set off by a vertical line to form a column of timing displays 48. To the right of the timing displays is a vertical column of identifier swatches 46. At the bottom of the unit is a keyboard input 42, location keys 47, and a directional input key 50. The base unit 10' is fabricated as a single-board microcomputer. A low-power CMOS (complementary metal oxide semiconductor) microprocessor with integral EPROM (erasable programmable read only memory) is employed. A small lithium battery provides backup for a clock/calendar RAM (random access memory) chip. The LCD screen 40 is mounted directly to the circuit board, as is the membrane-switch keyboard 42, the location keys 47, and the directional input keys 50. A molded plastic case 52 with cutouts for the screen 40 and keyboard input 42, location keys 47, and directional input keys 50 encloses the circuit board. Power is provided by batteries or, alternately, by a cordset transformer (not shown), which delivers approximately 15 volts AC to the unit through a relatively slender power cord (not shown) which can be looped around the hinge side of the refrigerator.

All the functions of the manual/magnetic tab version 10 of the invention are implemented through software in the microprocessor version 10'. The overall method of using the unit 10' is essentially unchanged. After the food item is placed in a container 14, the cataloging task inputs the item name and lifetime. To accomplish this, one simply presses the first letter of items named on the keyboard 42. The unit's ROM (read only memory) contains more than 100 items. For example, if one pressed "A," the first ROM item starting with "A" would appear in the topmost empty item slot. In this example, that would be "APPLE." If that is not the desired item, then the second letter of the name can be pressed, and the first item that has those two letters will appear. This is continued until the desired name appears.

If the name is not found, it can be entered by typing out the entire name on the keyboard 42. If the item is in the ROM, the lifetime automatically appears in the timing display 48. If the item is a newly-entered custom item, "?" flashes in the timing display, indicating that the operator must enter a lifetime. The suggested lifetime may be increased or decreased by pushing the "up" or "down" arrow keys of the directional input 50. Custom entries can be permanently saved in an onboard nonvolatile memory. Because the computer is always aware of the product lifetime, the unit always operates in the countdown mode wherein the lifetime numbers decrease day by day until they become negative. At that point the entire name flashes to indicate that the item is no longer fit to eat. The product expiration date also works in countdown mode. The computer is aware of the calendar date, so when a month/day is input, it is immediately converted to a lifetime in days for the countdown mode.

The memory actually maintains three separate lists: one for the refrigerator (R), one for the freezer (F), and one for the pantry (P). When the operator presses a location key 47, the appropriate list is displayed and may then be accessed.

The association task works with the identifier swatches 46 in much the same manner as with the manual version 10 of the invention: after the item is placed in a food storage container 14, an item slot 44 is selected whose identifier swatch 46 matches the identifier 22 of that container 14. The directional input keys 50 allow one to move the recently-inputted item from the topmost empty item slot to a lower slot so one can have some choice of identifiers. If an identifier-marked container 14, 22 is not used, a special symbol can be placed on the screen 40 to so indicate.

Any item slot 44 can be selected with the directional input keys 50 or by slot number so that it is easy to modify the line or to clear the slot 44 when the stored item is consumed. The battery-backed clock/calendar records the identity and timing status of each item so that power interruptions will not cause a loss of data.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A method to ensure the consumption of an item of perishable food before the item has been held in a storage location beyond its useful storage lifetime, comprising the steps of:

providing a base unit, located near the storage location, bearing at least one numeric display which displays elapsed time;

placing the item of food into the storage location;

recording the name and storage lifetime of the item of food on the base unit; and activating the numerical display, whereby the stored food item listed on the base unit may be safely consumed until the numeric display shows that the item has been stored beyond its safe lifetime.

2. The method of claim 1 further comprising the steps of:

providing a plurality of identifiers visible on the base unit, an identifier associated with each recorded item name;

providing a plurality of food storage containers in a variety of different sizes, each container being marked with an identifier, the identifier matching at least one identifier on the base unit;

selecting a storage container appropriately sized to fit the item of food to be stored;

placing the food item into the container before placing the item into the storage location; and ensuring that the identifier associated with the item name recorded on the base unit matches the identifier of the selected container.

3. A method to ensure the consumption of perishable food items before the items are stored beyond their useful storage lifetimes, comprising the steps of:

providing an item of food to be stored;

providing a storage location;

providing a base unit, located near the storage location, bearing a plurality of item slots, the item slots structured for receiving a written representation of the name of the food item, and a numeric representation, in timing increments, of the useful storage lifetime of the item, and bearing a plurality of numeric displays of elapsed time in the same timing increments as the storage lifetime, a display associated with an item slot;

placing the item of food into the storage location;

selecting an item slot that is not associated with a name and lifetime;

placing the name and lifetime of the item of food in association with the selected item slot; and activating the numerical display associated with the selected item slot, whereby the stored food item listed in the selected item slot may be safely consumed until the numeric display shows that the item has been stored beyond its safe lifetime.

4. The method of claim 3 wherein the storage location is selected from a group comprising a pantry, a freezer, and a refrigerator.

5. The method of claim 3 wherein preprinted and handwritten tabs are provided so that the tabs may be removably attached to the base unit in association with the selected item slot.

6. The method of claim 5 wherein a plurality of electronic timing circuits with associated electronic displays are provided on the base unit, a display associated with each item slot, with a plurality of activating and deactivating switches, at least one switch associated with each electronic display and controlling the timing circuit of the display.

7. The method of claim 3 wherein the item slots and the numeric displays of the base unit are provided by a microprocessor.

8. The method of claim 3 wherein the timing increments are selected from a group comprising days, weeks, and months.

9. The method of claim 3 further comprising the steps of:

providing a plurality of identifiers visible on the base unit, an identifier associated with an item slot;

providing a plurality of food storage containers in a variety of different sizes, each container being marked with an identifier, the identifier matching at least one identifier on the base unit;

selecting a storage container appropriately sized to fit the item of food to be stored;

placing the food item into the open container and closing the container before placing the item into the storage location; and ensuring that the identifier associated with the selected item slot matches the identifier of the selected container.

10. A method to ensure the consumption of perishable food items before the items are stored beyond their useful storage lifetimes, comprising the steps of:

providing an item of food to be stored;

providing a refrigerator;

providing a base unit detachably mounted to the refrigerator bearing a plurality of item slots, a plurality of visible identifiers, an identifier associated with an item slot, the item slots structured to receive both a written representation of the name of the food item, and also a numeric representation, in days, of the useful storage lifetime of the item, and bearing a plurality of numeric displays of elapsed time in days, a display associated with an item slot with a plurality of activating and deactivating switches, at least one switch associated with each electronic display and controlling the display;

providing a plurality of food storage containers in a variety of different sizes, each container marked with an identifier, the identifier matching the identifier associated with at least one of the item slots on the base unit;

selecting a storage container sized to fit the food item to be stored;

placing the item into the open container and closing the container;

placing the selected storage container holding the food item into the refrigerator;

selecting an item slot that does not contain a name and lifetime and whose identifier matches the identifier of the selected storage container;

placing the name and lifetime of the food item in the selected container in association with the selected item slot;

activating the numeric display associated with the selected item slot;

whereby the food item in the selected container may be safely consumed until the numeric display shows that the item has been stored beyond its lifetime.

11. The method of claim 10 wherein preprinted and handwritten magnetic tabs are provided so that the tabs may be removably attached magnetically to the base unit in association with the selected item slot.

12. The method of claim 11 wherein a plurality of electronic timing circuits with associated electronic displays are provided so that a display is associated with each item slot and with a plurality of activating and inactivating switches, at least one switch being associated with each electronic display and controlling the timing circuit of the display.

13. The method of claim 10 wherein the item slots and numeric displays of the base unit are provided by a microprocessor.

14. A device to ensure the consumption of perishable food items in a storage location before the items are stored beyond their storage lifetimes, comprising:

a base unit, locatable near the storage location, bearing a plurality of item slots, the base unit having means for cataloging and means for timing:

the means for cataloging comprising means to provide a written representation of the name of the food item, and a numeric representation, in timing increments, of the useful storage lifetime of the item, and means to associate the name and lifetime with an item slot on the base unit; and the means for timing comprising a plurality of numeric displays of elapsed time in the same timing increments as the storage lifetime, a display associated with an item slot, and means to activate and inactivate the numeric display.

15. The device of claim 14 wherein the cataloging means comprises preprinted and handwritten tabs that may be removably attached to the base unit in association with an item slot.

16. The device of claim 15 wherein the timing means comprises a plurality of electronic timing circuits with associated electronic displays, a display associated with each item slot, and a plurality of activating and deactivating switches, at least one switch associated with each electronic display and controlling the timing circuit of the display.

17. The device of claim 14 wherein the cataloging means and the timing means are provided by a microprocessor with associated display means and input means.

18. The device of claim 14 wherein the timing increments are selected from a group comprising days, weeks, and months.

19. The device of claim 14 further comprising:

a plurality of identifiers visible on the base unit, an identifier associated with an item slot; and a plurality of food storage containers in a variety of different sizes, each container marked with an identifier, the identifier matching at least one of the identifiers on the base unit.

20. A device to ensure the consumption of perishable food items stored in a refrigerator before the items are stored beyond their useful storage lifetimes, comprising:

a base unit removably attached to the refrigerator and bearing a plurality of item slots, and a plurality of visible identifiers, an identifier associated with an item slot, the base unit having means for cataloging, and means for timing:

the means for cataloging comprising means to provide a written representation of the name of the food item, and a numeric representation, in days, of the useful storage lifetime of the item, and means to associate the name and lifetime with an item slot on the base unit;

the means for timing comprising a plurality of numeric displays of elapsed time in days, a display associated with an item slot, and means to activate and inactivate the numeric display; and a plurality of food storage containers in a variety of different sizes, each container marked with an identifier, the identifier matching at least one of the identifiers on the base unit.

21. The device of claim 20 wherein the cataloging means comprises preprinted and handwritten magnetic tabs that may be removably attached magnetically to the base unit in association with an item slot.

22. The device of claim 21 wherein the timing means comprises a plurality of electronic timing circuits with associated electronic displays, a display associated with each item slot, and a plurality of activating and inactivating switches, at least one switch being associated with each electronic display and controlling the timing circuit of the electronic display.

23. The device of claim 20 wherein the cataloging means and the timing means are provided by a microprocessor with associated display screen and input means.

* * * * *